US008987996B2

(12) United States Patent
Chang et al.

(10) Patent No.: US 8,987,996 B2
(45) Date of Patent: Mar. 24, 2015

(54) LIGHT EMITTING MODULE

(71) Applicant: Gunitech Corp., Hsinchu County (TW)

(72) Inventors: Wen-Hsin Chang, Hsinchu County (TW); Jiun-Hua Yang, Hsinchu County (TW); Po-Kuei Chou, Hsinchu County (TW); Chien-Ju Hung, Hsinchu County (TW)

(73) Assignee: Gunitech Corp., Hsinchu County (TW)

( * ) Notice: Subject to any disclaimer, the term of this patent is extended or adjusted under 35 U.S.C. 154(b) by 118 days.

(21) Appl. No.: 13/747,565

(22) Filed: Jan. 23, 2013

(65) Prior Publication Data

US 2014/0203723 A1 Jul. 24, 2014

(51) Int. Cl.
*H05B 33/08* (2006.01)

(52) U.S. Cl.
CPC ..... *H05B 33/0845* (2013.01)
USPC ..... 315/210; 315/34

(58) Field of Classification Search
CPC ..... H05B 37/0272; H05B 39/088
USPC ..... 315/34, 86, 152, 158, 185 R, 210, 291, 315/294, 360
See application file for complete search history.

(56) References Cited

U.S. PATENT DOCUMENTS

| | | | | |
|---|---|---|---|---|
| 7,049,761 | B2 * | 5/2006 | Timmermans et al. | 315/246 |
| 2007/0007898 | A1 * | 1/2007 | Bruning | 315/34 |
| 2010/0320922 | A1 * | 12/2010 | Palazzolo et al. | 315/210 |
| 2011/0204778 | A1 * | 8/2011 | Sadwick et al. | 315/34 |
| 2013/0241406 | A1 * | 9/2013 | Houri | 315/34 |
| 2013/0285544 | A1 * | 10/2013 | Molezion | 315/34 |

* cited by examiner

*Primary Examiner* — Douglas W Owens
*Assistant Examiner* — Pedro C Fernandez
(74) *Attorney, Agent, or Firm* — Alan D. Kamrath; Kamrath IP Lawfirm, P.A.

(57) ABSTRACT

A light emitting diode module includes a main base board, a wireless communication module, multiple light emitting diodes, a power output control system and a control unit. The wireless communication module is used for receiving a control signal. The light emitting diodes are disposed on the main base board and include light emitting diodes having at least one color. The power output control system is electrically connected to the light emitting diodes. The power output control system adjusts an amount of current flowing through each light emitting diode to control the light emitting diodes to emit light by adjusting the amount of current. The control unit is electrically connected to the wireless communication module and the power output control system for controlling the power output control system to adjust the amount of current of each light emitting diode.

9 Claims, 8 Drawing Sheets

LIGHT EMITTING MODULE

BACKGROUND OF THE INVENTION

1. Field of the Invention

The present invention is related to a light emitting diode module, and is particularly related to a light emitting diode module that uses a wireless device to control its light emitting and that integrates a power input control system into a main base board.

2. Description of the Prior Art

Compared with conventional white light, fluorescent light, or other light sources, the light emitting diode has the advantages of low temperature, high luminescence efficiency, low environmental impact, and long life time and has gradually become the first option for various luminescence apparatuses.

Generally, a light emitting diode is disposed on a main base board and is then installed in a tube or a light bulb. A power input control system is used for controlling the light emitting diode to emit light. Conventional main base boards are used for only disposing light emitting diodes, and power input control systems and wireless devices are not integrated into the main base board. Therefore, it is not convenient to assemble such devices, and there is a certain problem of heat dissipation.

SUMMARY OF THE INVENTION

A major objective of the present invention is to provide a light emitting diode module that can be controlled by a wireless device. In addition, a power input control system is integrated on a main base board.

To achieve the objective, the light emitting diode module can receive a control signal input by users. The light emitting diode module includes a main base board, a wireless communication module, a plurality of light emitting diodes, a power output control system and a control unit.

The wireless communication module is used for receiving a control signal. The plurality of light emitting diodes is disposed on the main base board. The plurality of light emitting diodes comprises light emitting diodes having at least one color. The power output control system is electrically connected to the plurality of light emitting diodes. The power output control system is used for adjusting an amount of current flowing through each of the light emitting diodes. By adjusting the amount of current, the plurality of light emitting diodes is controlled, such that the color or brightness of the light emitted by the plurality of light emitting diodes can be varied. The control unit is electrically connected to the wireless communication module and the power output control system. The control unit controls the power output control system to adjust the amount of current flowing through each light emitting diode.

BRIEF DESCRIPTION OF THE DRAWINGS

The above and other objectives, features, and advantages of the present invention are hereunder illustrated with specific embodiments in conjunction with the accompanying drawings and therefore rendered distinctive and comprehensible, in which.

DETAILED DESCRIPTION OF THE EMBODIMENTS OF THE INVENTION

Figure 1:
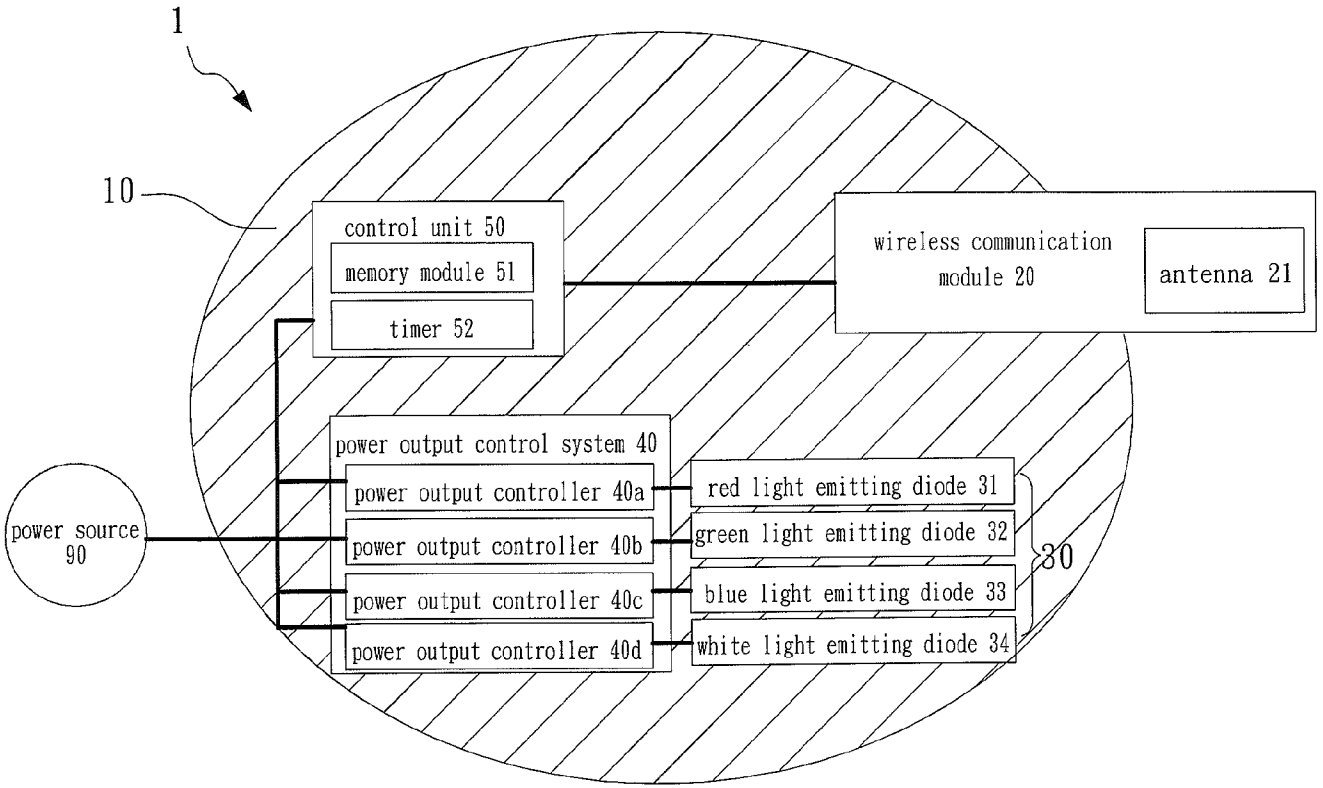
FIG. 1 illustrates a structure diagram of a light emitting diode module in a first embodiment according to the present invention.

Please refer to FIG. 1, which illustrates a structure diagram of a light emitting diode module according to a first embodiment of the present invention.

As illustrated in FIG. 1 in the first embodiment of the invention, the light emitting diode module 1 includes a main base board 10, a wireless communication module 20, a plurality of light emitting diodes 30, a power output control system 40 and a control unit 50. The invention, however, is not limited to such configuration. For example, the wireless communication module 20 and the control unit 50 may be combined to be a single unit.

In the first embodiment of the invention, the main base board 10 is made of aluminum material and the main base board 10 has a circular plate shape. The invention, however, is not limited to such configuration. For example, the shape of the main base board 10 can be designed as an irregular shape according design requirements.

In the first embodiment of the invention, the wireless communication module 20 is disposed on the main base board 10. The wireless communication module 20 includes an antenna 21 that extends to one side of the main base board 10 for preventing signals from being blocked due, to a shielding effect to the antenna 21. The wireless communication module 20 is used for receiving a control signal of a user. In the embodiment, the wireless communication module 20 is a Bluetooth device,. and the antenna 21 is a Bluetooth antenna. The invention, however, is not limited to Bluetooth devices, and may, for example, cover infrared transmission devices, wireless network devices or voice control devices. For example, the wireless communication module 20 can be a voice control device, and the control signal can be a voice control signal.

In the first embodiment of the invention, the light emitting diodes 30 are disposed on the main base board 10. The light emitting diodes 30 include a red light emitting diode 31, a green light emitting diode 32, a blue light emitting diode 33 and a white light emitting diode 34. In the embodiment, the light emitting diodes 30 are integrated in the same light ball. By adjusting the brightness of the light emitting diodes 31, 32, 33 and 34 of different colors, the light emitting diode module 1 as a whole emits light of various colors; i.e., the light ball emits light of multiple colors, including colors other than red, green, blue and white.

In the first embodiment of the invention, the power output control system 40 is disposed on the main base board 10. The power output control system 40 includes a plurality of power output controllers 40*a*, 40*b*, 40*c* and 40*d*, and each power output controller 40*a*, 40*b*, 40*c* and 40*d* is respectively electrically connected to the light emitting diodes 31, 32, 33 and 34 having different colors. The power output control system 40 is used for receiving current input from the power source 90 and adjusts the amounts of current being output to each of the light emitting diodes 31, 32, 33 and 34. By adjustment of the amounts of current flowing through each of the light emitting diodes 31, 32, 33 and 34, the color or brightness of the plurality of light emitting diodes as a whole can be changed. For example, when the power output control system 40 controls current of a certain ratio flowing through the red light emitting diode 31 and the green light emitting diode 32 while no current is flowing through the blue light emitting diode 33 and the white light emitting diode 34, the plurality of light emitting diodes as a whole give out yellow light.

In the first embodiment of the invention, the control unit 50 is disposed on the main base board 10 and is electrically connected to the wireless communication module 20 and the power output control system 40. The control unit 50 includes a memory module 51 and a timer 52. The memory module 51 is used for storing a control parameter so that after the control unit 50 receives the control signal, the power output control system 40 adjusts the input current flowing to each light emitting diode 30 according to the control parameter. As such, the color, brightness or timing of light emission of the plurality of light emitting diodes may be controlled. In addition, the control unit 50 may individually be used for controlling the color, brightness, or positive or negative light emission according to the control signal input by users. The timer is used for counting time.

For example, users may set a time parameter of a timing switch of the light emitting diode module 1 via a Bluetooth device of a mobile phone. For example, the light emitting diode module 1 is set to emit light from 11 pm each evening to 8 am the next morning. After the control parameter is input from a mobile phone to the light emitting diode module 1, it is stored in the memory module 51 of the control unit 50. After users program the timer to emit light from 11 pm every night to 8 am the next morning, i.e., inputting the control signal, the control unit 50 controls the light emitting diode module 1 to emit light during the set time. On the other hand, when users want to cancel the timing switch function of emitting light from 11pm each night to 8 am the next morning, users may use their Bluetooth devices to turn off the timing switch function. After it is turned off, the control unit 50 no longer controls the light emitting diode module 1 to emit or not to emit light according to the control parameter that was set previously. In addition, users may use Bluetooth devices to delete or to reset the control parameter or to add a new control parameter to the memory module 51. For example, in addition to emitting light from 11 pm each night to 8 am the next morning, the control unit 50 can be set, such that light is automatically emitted from 5 pm each evening to 8 pm at night.

For another example, users may use Bluetooth devices in their mobile phones to input color parameters for changing the color of light emitted by the light emitting diode module 1 during different times. For example, the light emitting diode module 1 may be set to emit white light from 6 pm each evening to 11 pm at night, and to emit red light from 11 pm at night to 6 am the next morning. Similarly, these control parameters are input to the light emitting diode module 1 and then are stored in the memory module 51 for users to request the control unit 50 to execute.

Figure 2:
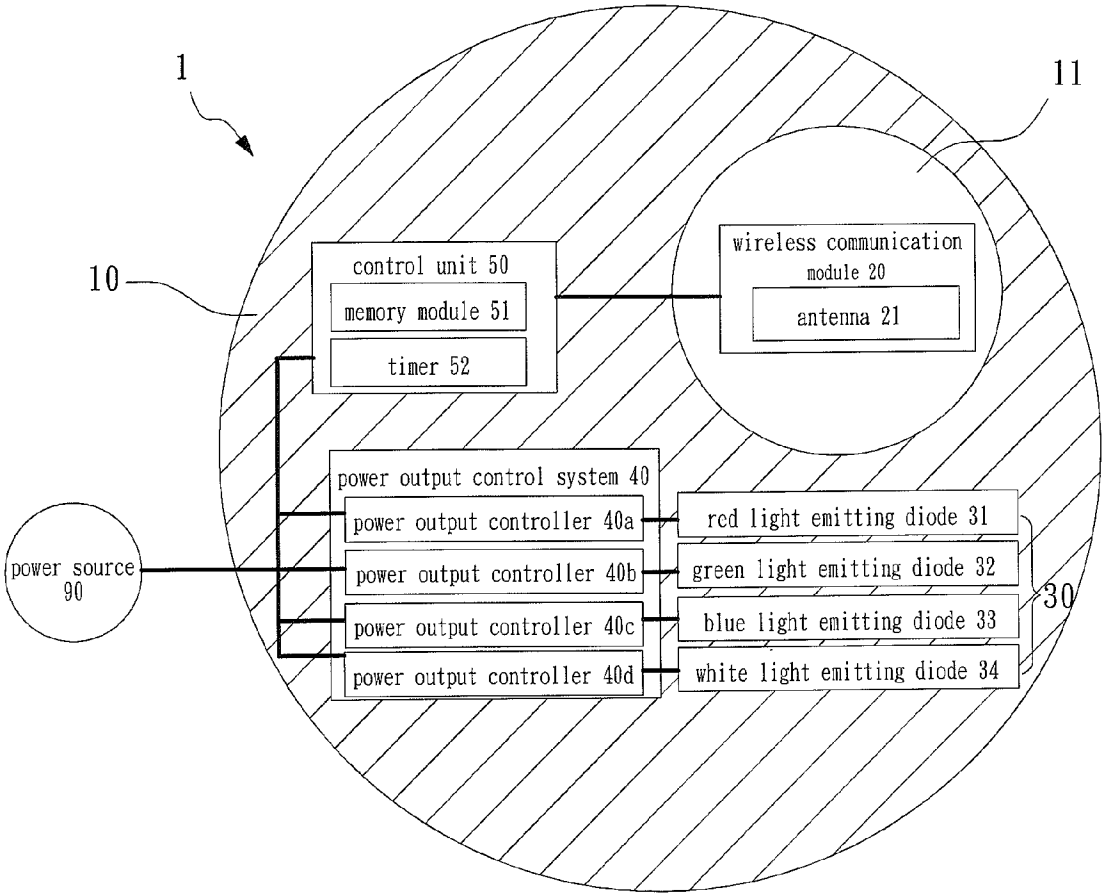
FIG. 2 illustrates a structure diagram of a light emitting diode module in a second embodiment according to the present invention.

Next, please refer to FIG. 2, which illustrates a structure diagram of a light emitting diode module according to a second embodiment.

As shown in FIG. 2, in a second embodiment of the present invention, the main base board 10 has a breaking hole 11, and the antenna 21 is located at the position of the breaking hole to prevent signals from being blocked due to shielding of the main base board 10.

Figure 3:
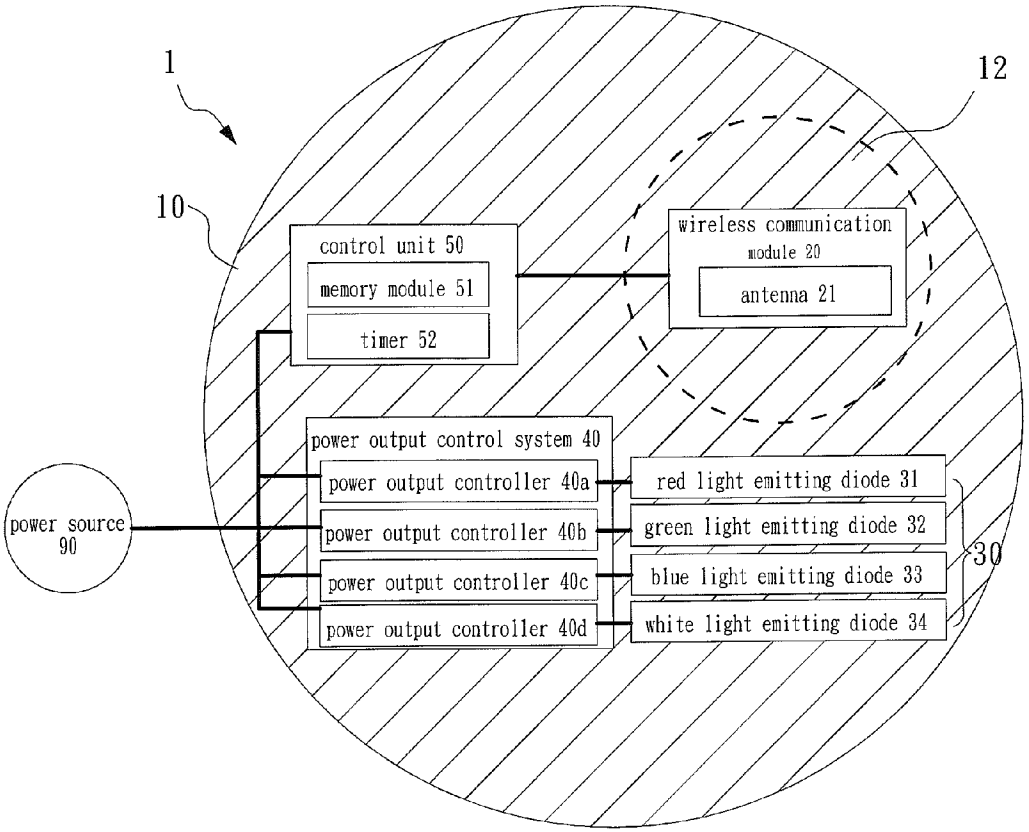
FIG. 3 illustrates a structure diagram of a light emitting diode module in a third embodiment according to the present invention.

Please refer to FIG. 3, which illustrates a structure diagram of the light emitting diode module in a third embodiment of the present invention.

As illustrated in FIG. 3, in a third embodiment of the present invention, the main base board 10 has a communication area 12. The communication area 12 is made of plastic material, and the antenna is located in the communication area 12 to prevent signals from being blocked due to a shielding effect.

Figure 4:
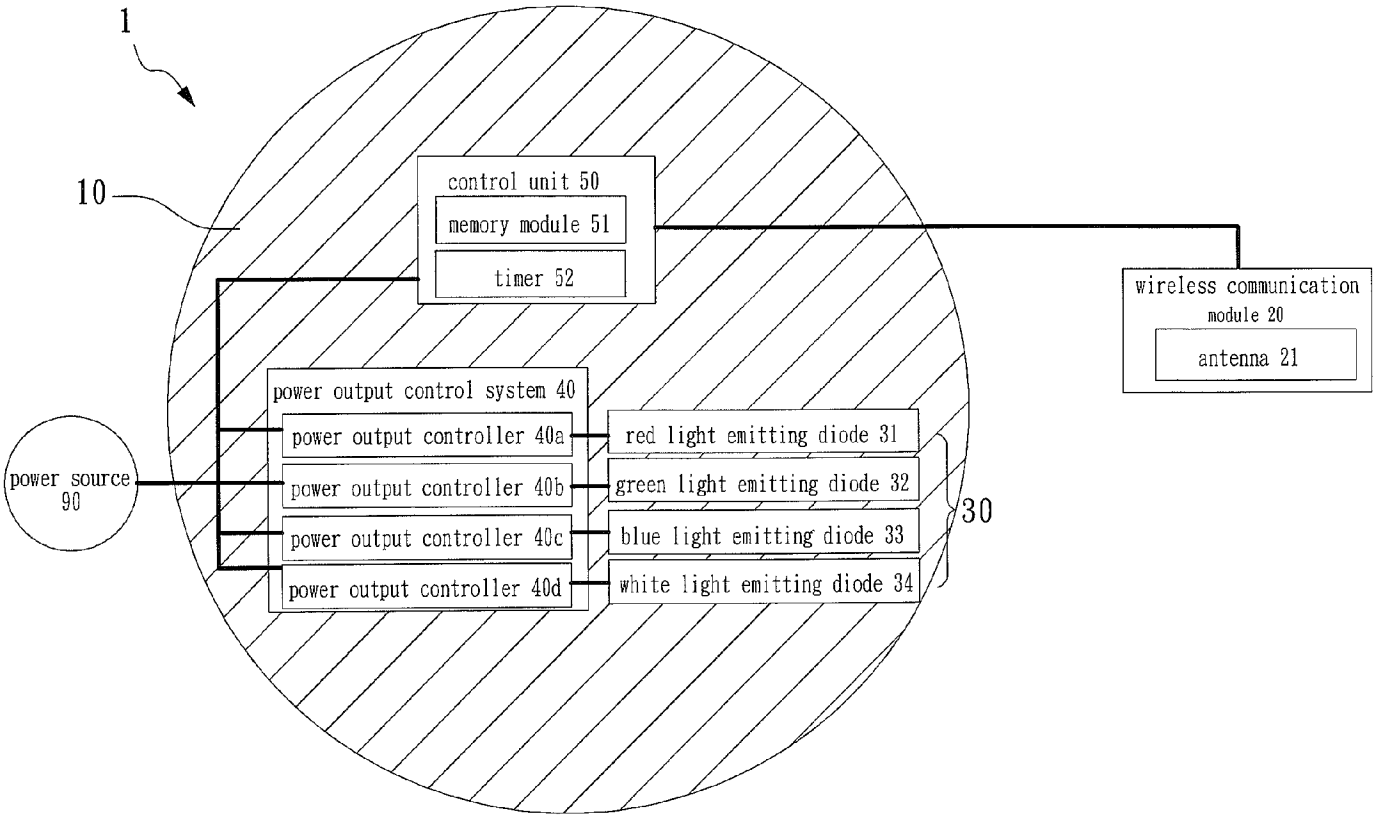
FIG. 4 illustrates a structure diagram of a light emitting diode module in a fourth embodiment according to the present invention.

Please refer to FIG. 4, which illustrates a light emitting diode module in a fourth embodiment of the present invention.

As illustrated in FIG. 4, in a fourth embodiment of the present invention, the wireless communication module 20 and the antenna 21 of the light emitting diode module 1 are located outside the main base board. In such a way, the shielding effect is also prevented.

Figure 5:
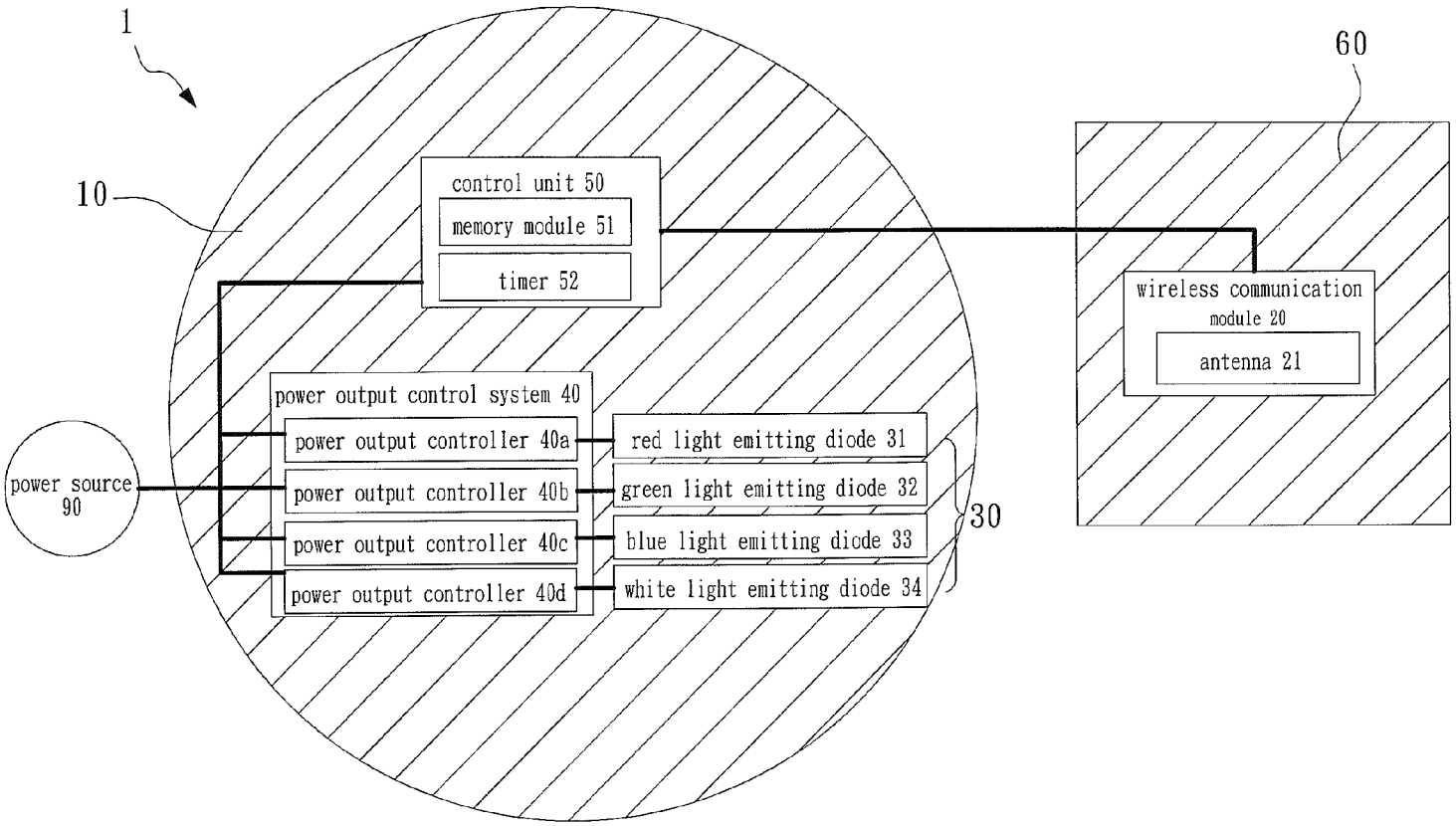
FIG. 5 illustrates a structure diagram of a light emitting diode module in a fifth embodiment according to the present invention.

Please refer to FIG. 5, which illustrates a structure diagram of a light emitting diode module in a fifth embodiment of the present invention.

As illustrated in FIG. 5, in a fifth embodiment of the present invention, the light emitting diode module 1 further includes a sub base board 60. The sub base board 60 is made of non-metal material. The wireless communication module 20 and the antenna 21 are disposed on the sub base board 60. Because the sub base board 60 is made of non-metal material, it causes no shielding effect for the antenna 21, and, thus, such approach also prevents blocking of the signals for the antenna 21 due to a shielding effect.

Figure 6:
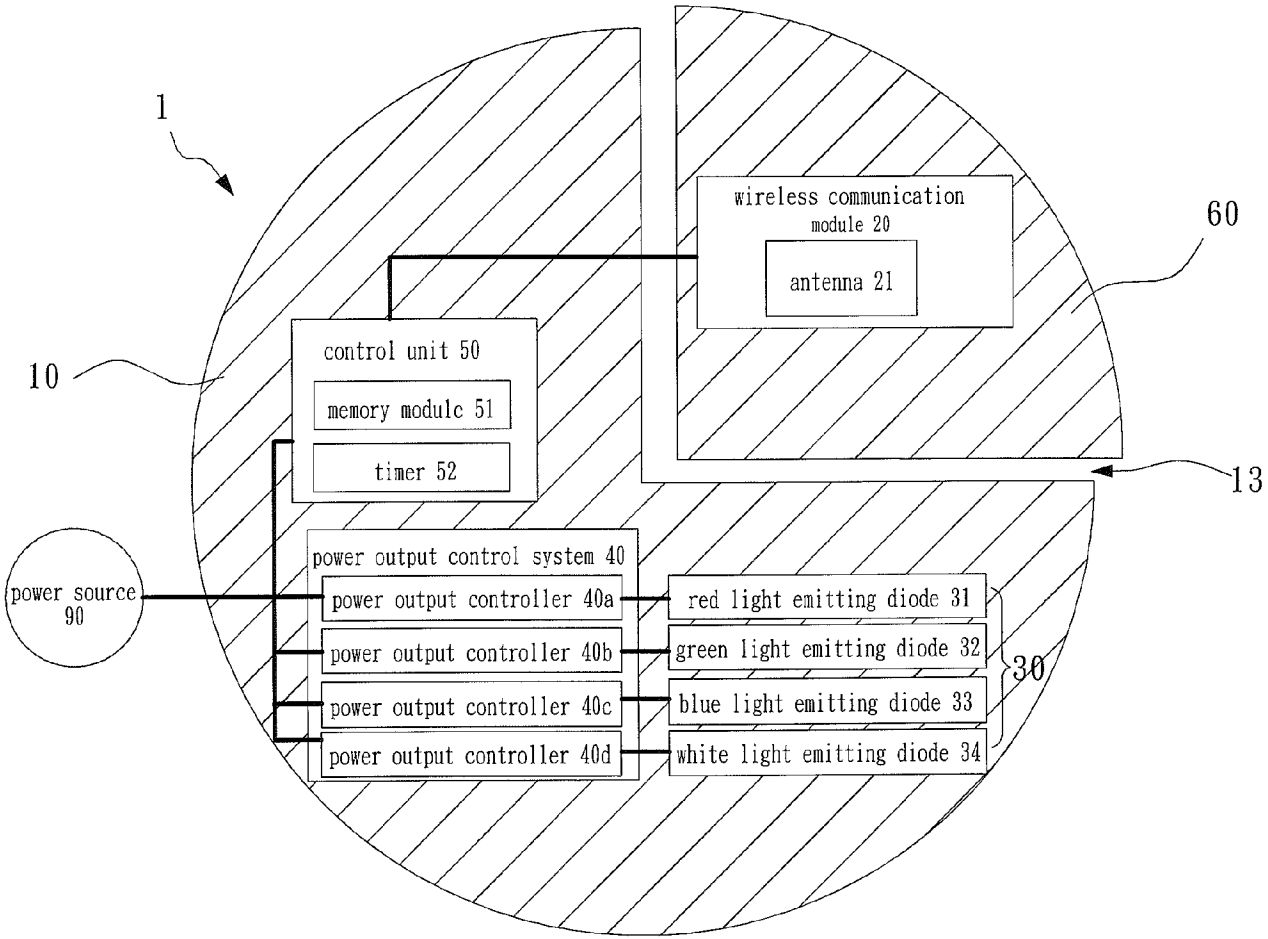
FIG. 6 illustrates a structure diagram of a light emitting diode module in a sixth embodiment according to the present invention.

Next, please refer to FIG. 6, which illustrates a structure diagram of a light emitting diode module in a sixth embodiment of the present invention.

As illustrated in FIG. 6, in a sixth embodiment of the present invention, the shape of the main base board 10 is not a circular plate shape but has a gap 13, and the sub base board is disposed at the position of the gap 13. With such a design, the material cost of manufacturing the main base board 10 and the sub base board 60 is reduced, and the space occupied by the two components is also reduced to reduce the size of the light emitting diode module 1. The invention, however, is not limited to such configuration. The wireless communication module 20 may also cross between the main base board 10 and the sub base board 60, and the antenna may remain in the range of the sub base board 60. As such, the manufacturing cost of connecting lines between the main base board 10 and the sub base board 60 can be further reduced.

Figure 7:
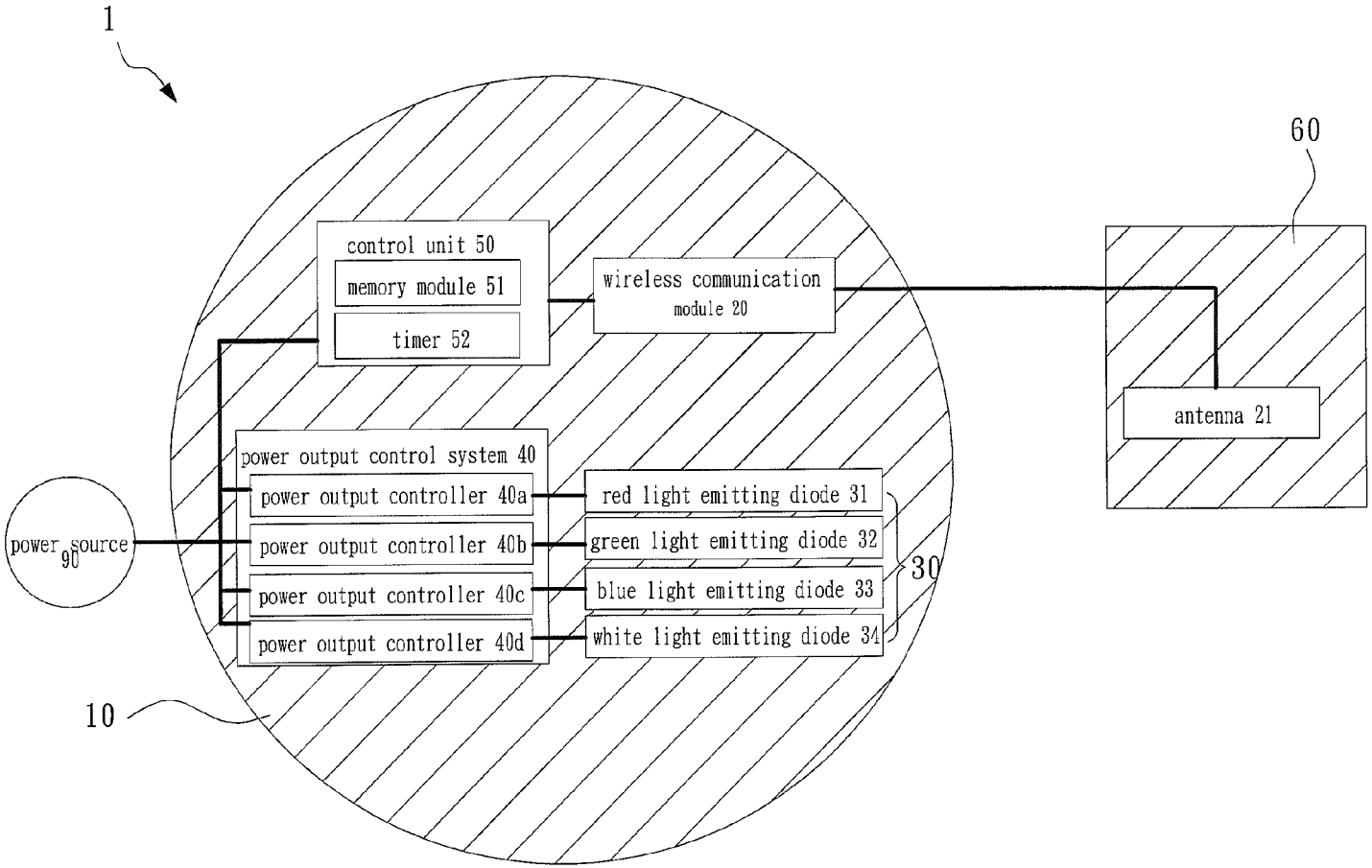
FIG. 7 illustrates a structure diagram of a light emitting diode module in a seventh embodiment according to the present invention.

Next, please refer to FIG. 7, which illustrates a structure diagram of a light emitting diode module in a seventh embodiment of the present invention.

As illustrated in FIG. 7, in the seventh embodiment of the present invention, the difference between the seventh embodiment and the fifth embodiment is primarily that the wireless communication module 20 and the antenna 21 are separately disposed. That is, the wireless communication module 20 is disposed on the main base board 10, and the antenna 21 is disposed on the sub base board 60. As such, the manufacturing cost and the size of the sub base board 60 can be reduced. The present invention, however, is not limited to such configuration. The antenna 21 can be electrically connected to the wireless communication module 20, and there is no need for the sub base board 60 at all.

Figure 8:
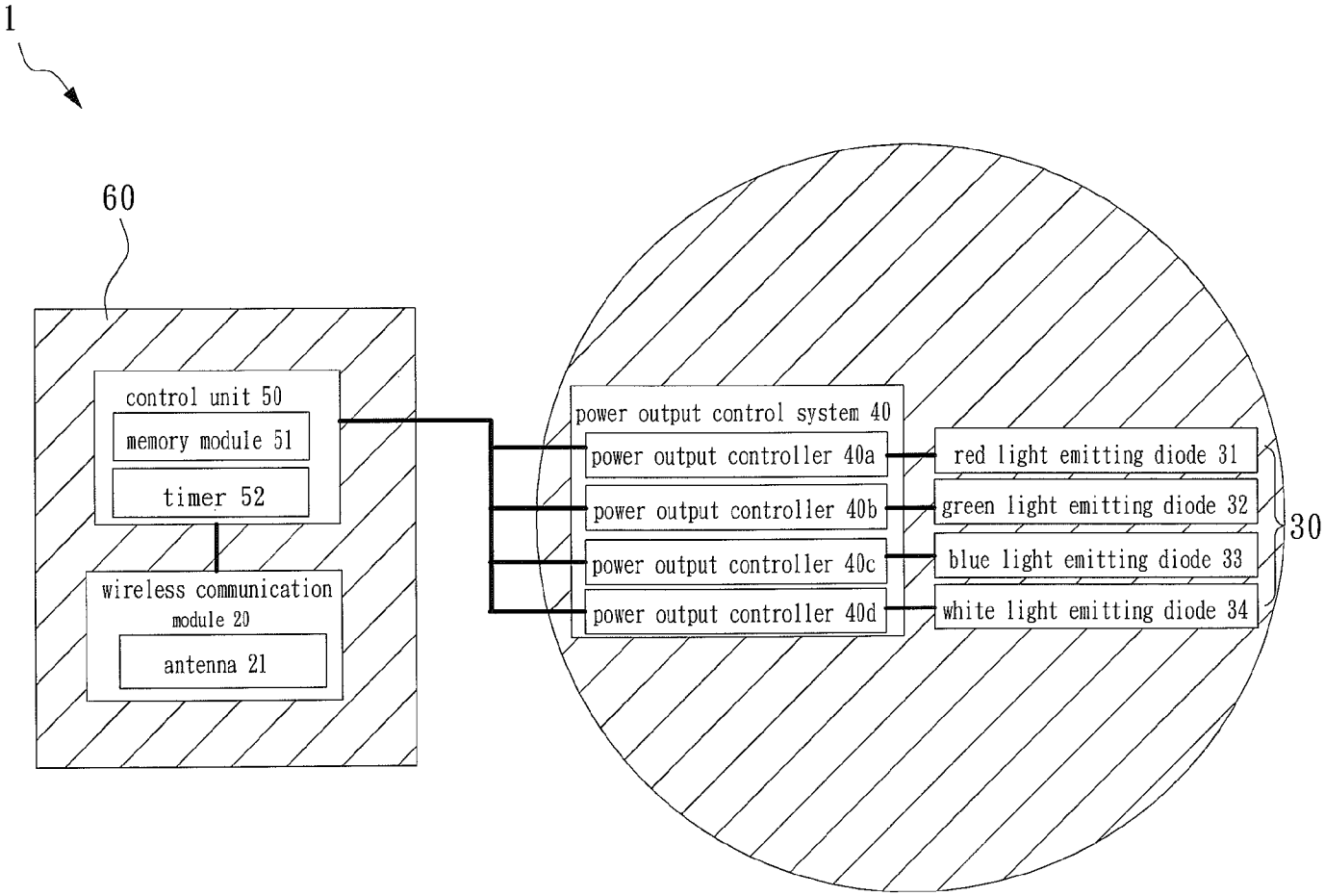
FIG. 8 illustrates a structure diagram of a light emitting diode module in an eighth embodiment according to the present invention.

Finally, please refer to FIG. 8, which illustrates a structure diagram of a light emitting diode module in an eighth embodiment of the present invention.

As illustrated in FIG. 8, in an eighth embodiment of the present invention, the difference between the eighth embodiment and the fifth embodiment is primarily that the control unit 50 is disposed on the sub base board 60 to reduce the size and manufacturing cost of the main base board.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A light emitting diode module for receiving a control signal, with the light emitting diode module comprising:

a main base board, wherein the main base board has a breaking hole;

a wireless communication module for receiving the control signal, wherein the wireless communication module comprises an antenna, wherein the antenna positioned corresponding to the breaking hole;

a plurality of light emitting diodes disposed on the main base board, wherein the plurality of light emitting diodes comprises light emitting diodes having at least one color;

a power output control system electrically connected to the plurality of light emitting diodes, with the power output control system adjusting an amount of current flowing through each of the plurality of light emitting diodes to control the plurality of light emitting diodes via adjustment of the amount of current for changing the color or brightness of the plurality of light emitting diodes; and a control unit electrically connected to the wireless communication module and the power output control system for controlling the power output control system to adjust the amount of current flowing through each of the plurality of light emitting diodes.

2. The light emitting diode module of claim 1, wherein the wireless communication module, the power output control system and the control unit are all disposed on the main base board.

3. The light emitting diodes of claim 2, wherein the control unit comprises a memory module and a timer, and wherein the memory module is used for storing a control parameter.

4. The light emitting diode module of claim 3, wherein after the control unit receives the control signal, the color, brightness or timing of light emission of the plurality of light emitting diodes is controlled according to the control parameter.

5. The light emitting diode module of claim 1, wherein the wireless communication module and the antenna are located outside the main base board.

6. The light emitting diodes of claim 5, wherein the control unit comprises a memory module and a timer, and wherein the memory module is used for storing a control parameter.

7. The light emitting diode module of claim 6, wherein after the control unit receives the control signal, the color, brightness or timing of light emission of the plurality of light emitting diodes is controlled according to the control parameter.

8. The light emitting diodes of claim 1, wherein the control unit comprises a memory module and a timer, and wherein the memory module is used for storing a control parameter.

9. The light emitting diode module of claim 8, wherein after the control unit receives the control signal, the color, brightness or timing of light emission of the plurality of light emitting diodes is controlled according to the control parameter.

* * * * *